US008760084B2

(12) United States Patent
Lin et al.

(10) Patent No.: US 8,760,084 B2
(45) Date of Patent: Jun. 24, 2014

(54) DRIVING APPARATUS FOR FLUORESCENT TUBE AND METHOD THEREOF AND ILLUMINATION APPARATUS USING THE SAME

(75) Inventors: Chiu-Yuan Lin, Taipei (TW); Chien-Pang Hung, Taipei (TW); Chen-Lung Kao, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 279 days.

(21) Appl. No.: 13/241,208

(22) Filed: Sep. 23, 2011

(65) Prior Publication Data

US 2012/0169233 A1 Jul. 5, 2012

(30) Foreign Application Priority Data

Jan. 4, 2011 (TW) ..... 100100173 A

(51) Int. Cl.
*H05B 37/02* (2006.01)

(52) U.S. Cl.
USPC ..... 315/307; 315/88; 315/247

(58) Field of Classification Search
USPC ..... 315/88, 209 R, 224, 225, 246, 247, 250, 315/291, 294, 297, 307, 308, 360, 362
See application file for complete search history.

(56) References Cited

U.S. PATENT DOCUMENTS 5,969,483 A * 10/1999 Li et al. ..... 315/225
6,348,769 B1 * 2/2002 Pinchuk et al. ..... 315/307
7,154,232 B2 * 12/2006 Contenti et al. ..... 315/225
2010/0001649 A1 * 1/2010 Yamamoto et al. ..... 315/119
2011/0037401 A1 * 2/2011 Yu ..... 315/246
2011/0062878 A1 * 3/2011 Liess et al. ..... 315/250

FOREIGN PATENT DOCUMENTS

| | | |
|---|---|---|
| CN | 101690409 | 3/2010 |
| JP | 2002528871 | 9/2002 |
| TW | 200808124 | 2/2008 |
| TW | 201026151 | 7/2010 |
| TW | 201101931 | 1/2011 |
| WO | 2009158330 | 12/2009 |

OTHER PUBLICATIONS

"Office Action of Taiwan Counterpart Application", issued on Sep. 5, 2013, p. 1-p. 11.
"Office Action of China Counterpart Application", issued on Aug. 19, 2013, p. 1-p. 6.

* cited by examiner

*Primary Examiner* — Tung X Le
(74) *Attorney, Agent, or Firm* — Winston Hsu; Scott Margo

(57) ABSTRACT

A driving apparatus for a fluorescent tube and a method thereof and an illumination apparatus using the same are provided. The driving apparatus stops providing power, when a fluorescent tube has broken, to both ends of the broken fluorescent tube regardless of whether a power switch related to the fluorescent tube is in ON or OFF state, and thus making sure that a person is under a safety condition without getting an electric shock during replacing the broken fluorescent tube; moreover, the driving apparatus automatically detects the newly installed fluorescent tube and automatically light up the newly installed fluorescent tube after the broken fluorescent tube is replaced and it is unnecessary to switch the power switch related to the fluorescent tube anymore, and thus avoiding a potentially hazard for the person who climbs up and down a ladder repeatedly.

25 Claims, 4 Drawing Sheets

DRIVING APPARATUS FOR FLUORESCENT TUBE AND METHOD THEREOF AND ILLUMINATION APPARATUS USING THE SAME

CROSS-REFERENCE TO RELATED APPLICATION

This application claims the priority benefit of Taiwan application serial no. 100100173, filed on Jan. 4, 2011. The entirety of the above-mentioned patent application is hereby incorporated by reference herein and made a part of this specification.

BACKGROUND OF THE INVENTION

1. Field of the Invention

The invention relates to a driving technique for a fluorescent tube, more particularly, to a driving apparatus for a hot-cathode fluorescent tube, a method thereof and an illumination apparatus using the same.

2. Description of Related Art

Fluorescent tubes are generally used as illumination apparatus in daily life, wherein straight long tube type (hot-cathode) fluorescent tubes are most commonly used, and the fluorescent tubes have different tube diameters of T3, T5, T8 and T9 in specification. However, regardless of the fluorescent tube of the T3, T5, T8 or T9 specification, a light emitting principle thereof is the same, by which a tube current induces a mercury vapor to stimulate a fluorescent material on an inner wall of the tube to emit light.

Driving apparatuses of the existing fluorescent tubes (T9/T8/T5/T3) are generally divided into two types, and one type provides none protection mechanism/measure when the fluorescent tube is broken, and another type may provide a shutdown protection mechanism/measure when the fluorescent tube is broken. In detail, when the fluorescent tube installed on a lamp holder is broken, and when the driving apparatus of the fluorescent tube does not provide any protection mechanism/measure, the driving apparatus of the fluorescent tube continuously supplies power to both ends of the broken fluorescent tube. However, a person replacing the fluorescent tube is not necessarily a professional personnel, who may probably replace the fluorescent tube without first turning off a power switch related to the fluorescent tube. Therefore, during a fluorescent tube replacing process, the tube-replacing personnel may have a security problem of electric shock.

On the other hand, when the fluorescent tube installed on the lamp holder is broken, and when the driving apparatus of the fluorescent tube can provide the protection mechanism/measure, the driving apparatus of the fluorescent tube stops supplying power to both ends of the broken fluorescent tube, so that the tube-replacing personnel does not have the security problem of electric shock. However, the lamp holder of the fluorescent lamp is generally installed on the ceiling, and the power switch related to the fluorescent tube is generally installed on a wall, so that when the fluorescent tube is broken and is required to be replaced, since a height of the ceiling is relatively high, the tube-replacing personnel has to replace the broken fluorescent tube with assistance of a ladder.

However, in order to confirm whether the newly installed fluorescent tube is properly installed or whether the newly installed fluorescent tube is usable, the tube-replacing personnel has to first climb down the ladder to switch (i.e. to turn on or turn off) the power switch installed on the wall, so as to determine whether the newly installed fluorescent tube normally emits light. If the newly installed fluorescent tube cannot emit light, it represents that the newly installed fluorescent tube is probably not installed well or is not good, and the tube-replacing personnel has to re-climb up the ladder to fix the fluorescent tube or again replace the broken fluorescent tube, and then climbs down the ladder to switch the power switch installed on the wall to further confirm whether the newly installed fluorescent tube normally emits light.

Therefore, the tube-replacing personnel probably need to repeatedly climb up and down the ladder to successfully replace the fluorescent tube. In this way, not only more time and labor are consumed, there is a potential risk of falling down.

SUMMARY OF THE INVENTION

Accordingly, the invention is directed to a driving apparatus of a fluorescent tube and a method thereof and an illumination apparatus using the same, which can provide a power-off protection mechanism/measure when the fluorescent tube is broken. Meanwhile, after the fluorescent tube is replaced, the newly installed fluorescent tube can be automatically detected and automatically lighted up.

The invention provides a driving apparatus of a fluorescent tube, which includes a conversion unit, a power factor correction unit, a driving unit and a detection unit. The conversion unit receives an alternating current (AC) power, and converts the AC power to provide a direct current (DC) power. The power factor correction unit is coupled to the conversion unit for performing a power factor correction to the DC power provided by the conversion unit. The driving unit is coupled to the power factor correction unit for generating an AC driving signal in response to an output of the power factor correction unit, so as to drive a first fluorescent tube installed on a lamp holder.

The detection unit is coupled to the driving unit for detecting whether a high side filament and a low side filament of the first fluorescent tube are broken, wherein when at least one of the high side filament and the low side filament of the first fluorescent tube is broken, the detection unit makes the driving unit to stop generating the AC driving signal, and when the broken first fluorescent tube originally installed on the lamp holder is replaced by a good second fluorescent tube, the detection unit makes the driving unit to regenerate the AC driving signal to drive the second fluorescent tube.

In an embodiment of the invention, the detection unit includes a high voltage detection circuit. The high voltage detection circuit is coupled to the high side filament of the first fluorescent tube for detecting whether the high side filament of the first fluorescent tube is broken, and sending a first detecting signal having a first state to the driving unit when the high side filament of the first fluorescent tube is broken, so as to make the driving unit to stop generating the AC driving signal, and sending the first detecting signal having a second state to the driving unit when the broken first fluorescent tube originally installed on the lamp holder is replaced by the good second fluorescent tube, so as to make the driving unit to regenerate the AC driving signal.

In an embodiment of the invention, the detection unit further includes a low voltage detection circuit. The low voltage detection circuit is coupled to the low side filament of the first fluorescent tube for detecting whether the low side filament of the first fluorescent tube is broken, and sending a second detecting signal having a first state to the driving unit when the low side filament of the first fluorescent tube is broken, so as to make the driving unit to stop generating the AC driving signal, and sending the second detecting signal having a second state to the driving unit when the broken first fluorescent tube originally installed on the lamp holder is replaced by the good second fluorescent tube, so as to make the driving unit to regenerate the AC driving signal.

In an embodiment of the invention, each of the first and the second fluorescent tube is at least a T3, T5, T8 or T9 hot-cathode fluorescent tube.

The invention provides a method for driving a fluorescent tube, which includes following steps. An alternating current (AC) power is converted into a direct current (DC) power. A power factor correction is performed on the DC power. An AC driving signal is generated in response to the power-factor corrected DC power, so as to drive a first fluorescent tube installed on a lamp holder to emit light. It is detected whether a high side filament and a low side filament of the first fluorescent tube are broken. When at least one of the high side filament and the low side filament of the first fluorescent tube is broken, it is stopped generating the AC driving signal, and when the broken first fluorescent tube originally installed on the lamp holder is replaced by a good second fluorescent tube, the AC driving signal is regenerated to drive the second fluorescent tube.

In an embodiment of the invention, the driving method further includes continuously using the AC driving signal to drive the first fluorescent tube when none of the high side filament and the low side filament of the first fluorescent tube is broken.

In an embodiment of the invention, the driving method further includes continuously stopping generating the AC driving signal when the broken first fluorescent tube is still installed on the lamp holder.

The invention provides an illumination apparatus including a lamp holder installed with a fluorescent tube, a power switch and the aforementioned driving apparatus of the fluorescent tube.

According to the above descriptions, when the fluorescent tube is broken, the driving apparatus stops providing power to both ends of the broken fluorescent tube regardless of whether a power switch related to the fluorescent tube is in an ON state or an OFF state, and thus making sure that a tube-replacing personnel is under safety conditions without getting an electric shock during a process of replacing the broken fluorescent tube with a good fluorescent tube. Meanwhile, after the broken fluorescent tube is replaced, it is unnecessary to switch the power switch related to the fluorescent tube, and the newly installed fluorescent tube can be automatically detected and automatically lighted up, and thus avoiding a potentially hazard for the tube-replacing personnel who climbs up and down a ladder repeatedly.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
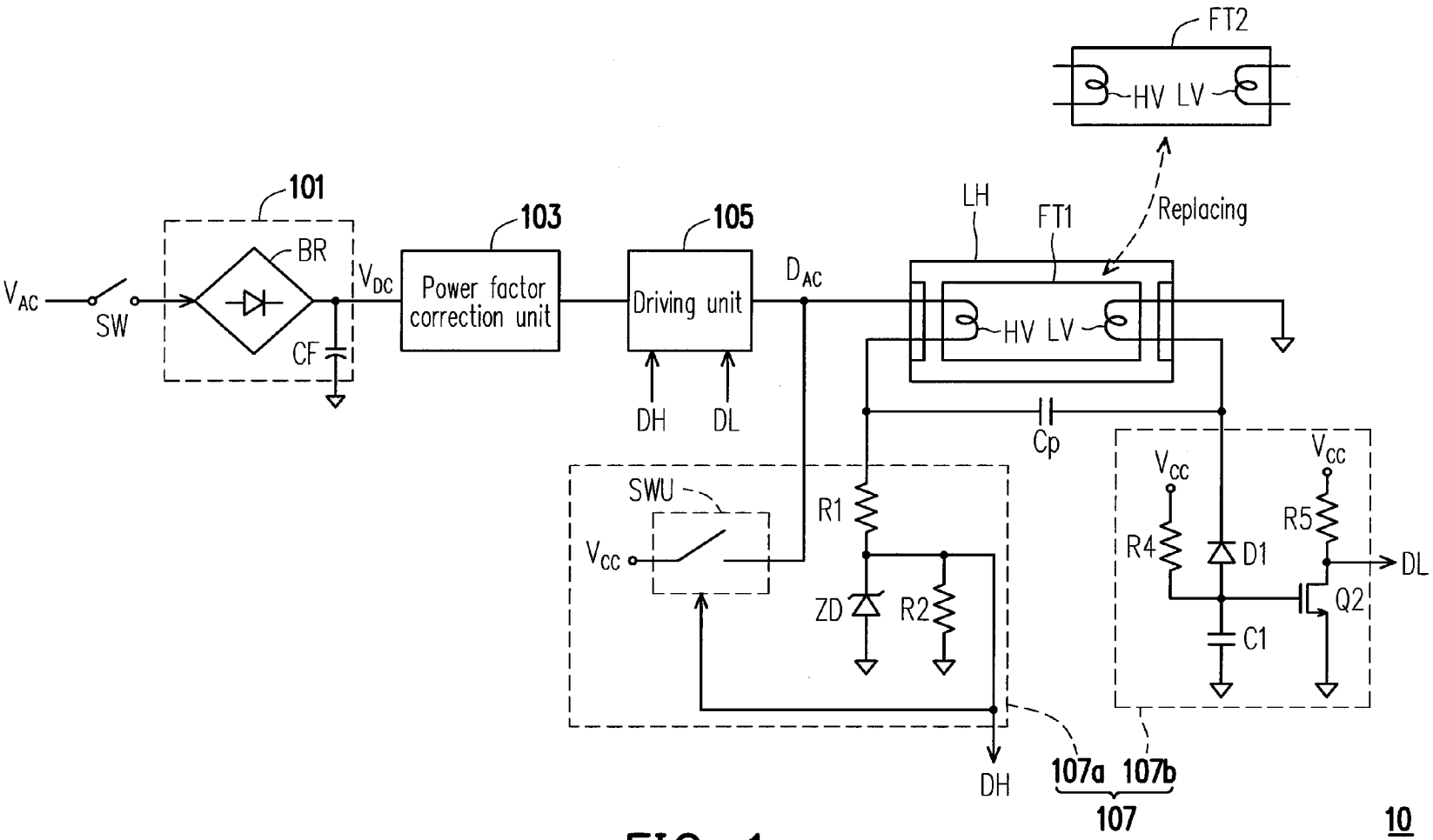
FIG. 1 is a schematic diagram of an illumination apparatus 10 according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram of an illumination apparatus 10 according to an embodiment of the invention. Referring to FIG. 1, the illumination apparatus 10 of the present embodiment includes a power switch SW, a lamp holder LH, and a driving apparatus composed of a conversion unit 101, a power factor correction unit (PFC unit) 103, a driving unit 105, a detection unit 107 and a capacitor Cp. The driving apparatus composed of the conversion unit 101, the PFC unit 103, the driving unit 105, the detection unit 107 and the capacitor Cp is used for driving a fluorescent tube installed on the lamp holder LH, for example, a fluorescent tube FT1 or FT2, and the fluorescent tube FT1 or FT2 can be a hot-cathode fluorescent tube of a T3, T5, T8 or T9 specification or other specifications.

In the present embodiment, a user can switch the power switch SW to turn on and turn off the fluorescent tube installed on the lamp holder LH. In other words, the driving apparatus composed of the conversion unit 101, the PFC unit 103, the driving unit 105, the detection unit 107 and the capacitor Cp drives the fluorescent tube installed on the lamp holder LH to emit light in response to an ON state of the power switch SW, and stops driving the fluorescent tube installed on the lamp holder LH in response to an OFF state of the power switch SW.

When the user wants to turn on the fluorescent tube (for example, the fluorescent tube FT1) installed on the lamp holder LH, the conversion unit 101 receives an alternating current (AC) power $V_{AC}$ in response to the ON state of the power switch SW, and converts the AC power $V_{AC}$ to provide a direct current (DC) power $V_{DC}$. In detail, the conversion unit 101 may include a bridge rectifier BR and a filter capacitor CF. The bridge rectifier BR receives the AC power $V_{AC}$, and performs a full-wave rectification or a half-wave rectification to the AC power $V_{AC}$ to provide the DC power $V_{DC}$. The filter capacitor CF is coupled to the bridge rectifier BR for filtering the DC power $V_{DC}$ provided by the bridge rectifier BR, so as to reduce a ripple factor of the DC power $V_{DC}$.

It should be noticed that according to an Energy-Star standard, an input power factor of a driving power of commercial illumination is not less than 0.9, and is not less than 0.7 for home illumination. Therefore, in the present embodiment, the PFC unit 103 is coupled to the conversion unit 101 for performing a power factor correction on the DC power $V_{DC}$ output by the conversion unit 101, so as to match the Energy-Star standard. Moreover, the driving unit 105 is coupled to the PFC unit 103, and generates an AC driving signal $D_{AC}$ with a high voltage (which generally has several hundreds volts) in response to an output of the PFC unit 103, so as to drive the fluorescent tube FT1 installed on the lamp holder LH.

Moreover, the detection unit 107 is coupled to the driving unit 105, and is used for detecting whether a high side filament HV and a low side filament LV of the fluorescent tube FT1 installed on the lamp holder LH are broken. When at least one of the high side filament HV and the low side filament LV of the fluorescent tube FT1 installed on the lamp holder LH is broken, the detection unit 107 makes the driving unit 105 to stop generating the AC driving signal $D_{AC}$. Moreover, when the broken fluorescent tube FT1 originally installed on the lamp holder LH is replaced by a good fluorescent tube FT2, the detection unit 107 makes the driving unit 105 to regenerate the AC driving signal $D_{AC}$ to drive the newly installed fluorescent tube FT2, where the power switch SW is unnecessary to be switched.

In detail, the detection unit 107 includes a high voltage detection circuit 107*a* and a low voltage detection circuit 107*b*. The high voltage detection circuit 107*a* is coupled to the high side filament HV of the fluorescent tube FT1 for detecting whether the high side filament HV of the fluorescent tube FT1 is broken, and sending a first detecting signal DH having a first state (for example, a low potential, 0V) to the driving unit 105 when the high side filament HV of the fluorescent tube FT1 is broken, so as to make the driving unit 105 to stop generating the AC driving signal $D_{AC}$, and sending the first detecting signal DH having a second state (for example, a high potential, which is about a system voltage $V_{CC}$) to the driving unit 105 when the broken fluorescent tube FT1 originally installed on the lamp holder LH is replaced by the good fluorescent tube FT2, so as to make the driving unit 105 to regenerate the AC driving signal $D_{AC}$ to drive the newly installed fluorescent tube FT2.

Moreover, the low voltage detection circuit 107*b* is coupled to the low side filament LV of the fluorescent tube FT1 for detecting whether the low side filament LV of the fluorescent tube FT1 is broken, and sending a second detecting signal DL having the first state (for example, the low potential, 0V) to the driving unit 105 when the low side filament LV of the fluorescent tube FT1 is broken, so as to make the driving unit 105 to stop generating the AC driving signal $D_{AC}$, and sending the second detecting signal DL having the second state (for example, the high potential, which is about the system voltage $V_{CC}$) to the driving unit 105 when the broken fluorescent tube FT1 originally installed on the lamp holder LH is replaced by the good fluorescent tube FT2, so as to make the driving unit 105 to regenerate the AC driving signal $D_{AC}$ to drive the newly installed fluorescent tube FT2.

In the present embodiment, the high voltage detection circuit 107*a* includes a switching unit SWU, resistors R1 and R2, and a Zener diode ZD. A first terminal of the switching unit SWU is coupled to the system voltage $V_{CC}$, a second terminal of the switching unit SWU is coupled to a first end of the high side filament HV of the fluorescent tube FT1, and the first end of the high side filament HV of the fluorescent tube FT1 further receives the AC driving signal $D_{AC}$ generated by the driving unit 105.

A first end of the resistor R1 is coupled to a second end of the high side filament HV of the fluorescent tube FT1 and a first end of the capacitor Cp. A cathode of the Zener diode ZD is coupled to a second end of the resistor R1, and an anode of the Zener diode ZD is coupled to a ground potential. A first end of the resistor R2 is coupled to the cathode of the Zener diode ZD and a control terminal of the switching unit SWU, and is used for generating the first detecting signal DH to the driving unit 105, and a second end of the resistor R2 is coupled to the ground potential.

Figure 2A:
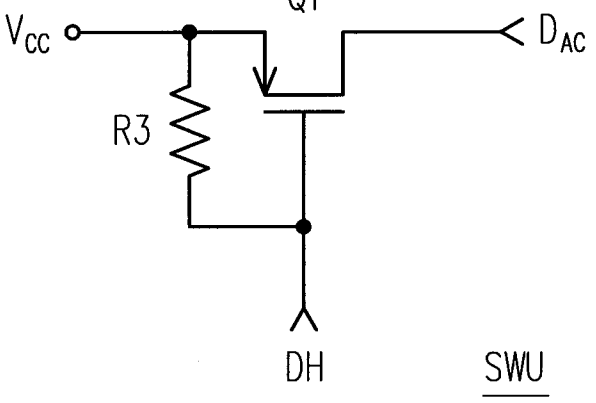
FIG. 2A is a schematic diagram of a switching unit SWU according to an embodiment of the invention.

In detail, the switching unit SWU may include a P-type transistor Q1 (for example, a PMOS transistor) and a resistor R3 as that shown in FIG. 2A. A first end of the resistor R3 is served as the first terminal of the switching unit SWU and coupled to the system voltage $V_{CC}$. A source of the P-type transistor Q1 is coupled to the system voltage $V_{CC}$, a drain of the P-type transistor Q1 is served as the second terminal of the switching unit SWU and coupled to the first end of the high side filament HV of the fluorescent tube FT1, and a gate of the P-type transistor Q1 is served as the control terminal of the switching unit SWU and coupled to a second end of the resistor R3.

Figure 2B:
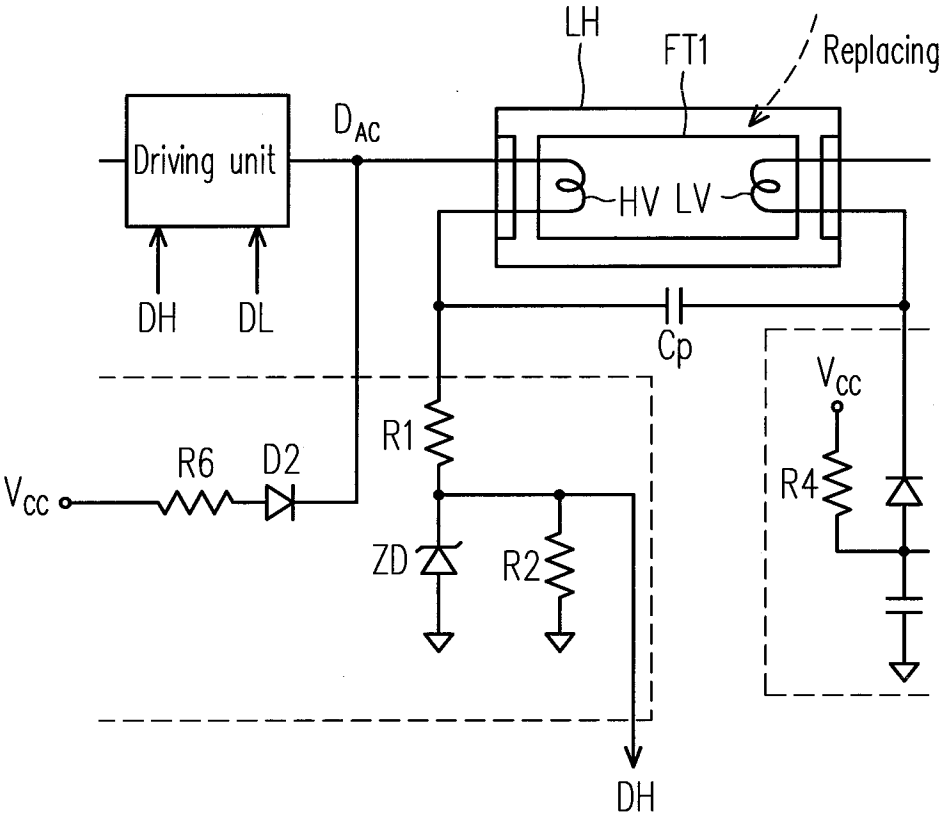
FIG. 2B is a circuit diagram of a high voltage detection circuit 107*a* according to another embodiment of the invention.

FIG. 2B is a circuit diagram of another implementation of the high voltage detection circuit 107*a*. In FIG. 2B, a first end of a resistor R6 is coupled to the system voltage $V_{CC}$, an anode of a diode D2 is coupled to a second end of the resistor R6, and a cathode of the diode D2 is coupled to the first end of the high side filament HV of the fluorescent tube FT1. Moreover, coupling relations of the devices that have the same referential numbers in FIG. 2B and FIG. 1 are similar, so that details thereof are not repeated. However, it should be noticed that a function of the diode D2 of FIG. 2B is to reduce a power consumption of the resistor R6 by a half to effectively reduce an operating temperature due to the circuit including the diode D2 and the resistor R6 only has a half duty cycle.

Moreover, the low voltage detection circuit 107*b* includes resistors R4 and R5, a diode D1, a capacitor C1 and an N-type transistor Q2 (for example, an NMOS transistor). A first end of the resistor R4 is coupled to the system voltage $V_{CC}$. A cathode of the diode D1 is coupled to a first end of the low side filament LV of the fluorescent tube FT1 and a second end of the capacitor Cp, an anode of the diode D1 is coupled to a second end of the resistor R4, and a second end of the low side filament LV of the fluorescent tube FT1 is coupled to the ground potential. A first end of the capacitor C1 is coupled to the anode of the diode D1, and a second end of the capacitor C1 is coupled to the ground potential. A gate of the N-type transistor Q2 is coupled to the first end of the capacitor C1, a source of the N-type transistor Q2 is coupled to the ground potential, and a drain of the N-type transistor Q2 is used for generating the second detecting signal DL to the driving unit 105. A first end of the resistor R5 is coupled to the system voltage $V_{CC}$, and a second end of the resistor R5 is coupled to the drain of the N-type transistor Q2.

According to the above descriptions, when the fluorescent tube FT1 installed on the lamp holder LH is good, and the user switches the power switch SW to turn on the fluorescent tube FT1, the driving unit 105 generates the AC driving signal $D_{AC}$ with a relatively high voltage to drive the fluorescent tube FT1 to emit light. Moreover, the capacitor Cp may provide a high-enough starting voltage during a transient process of starting the fluorescent tube FT1, and provide a suitable filament current when the fluorescent tube FT1 stably operates. Under such condition, since the high side filament HV and the low side filament LV of the fluorescent tube FT1 are not broken, the P-type transistor Q1 and the N-type transistor Q2 are all turned off. In this way, the high voltage detection circuit 107*a* and the low voltage detection circuit 107*b* respectively send the first detecting signal DH of the high potential and the second detecting signal DL of the high potential to make the driving unit 105 to continually generate the AC driving signal $D_{AC}$ with the relatively high voltage to drive the fluorescent tube FT1 to emit light.

During a light emitting process of the fluorescent tube FT1, it is assumed that the high side filament HV is broken, and the low side filament LV is not broken. In this case, since the resistor R2 is coupled to the ground, the high voltage detection circuit 107*a* sends the first detecting signal DH of the low potential to the driving unit 105, so that the driving unit 105 stops generating the AC driving signal $D_{AC}$. Meanwhile, the P-type transistor Q1 is turned on in response to the first detecting signal DH of the low potential, so that the system voltage $V_{CC}$ is transmitted to the first end of the high side filament HV of the fluorescent tube FT1.

When the broken fluorescent tube FT1 originally installed on the lamp holder LH is replaced by the good fluorescent tube FT2, since the high side filament HV of the fluorescent tube FT2 is not broken, the high voltage detection circuit 107*a* sends the first detecting signal DH of the high potential to the driving unit 105 in response to the system voltage $V_{CC}$, so that the driving unit 105 regenerates the AC driving signal $D_{AC}$ to drive the newly installed fluorescent tube FT2, and the power switch SW is unnecessary to be switched. Meanwhile, the P-type transistor Q1 is turned off in response to the first detecting signal DH of the high potential, so as to avoid shifting the AC driving signal $D_{AC}$ generated by the driving unit 105 to damage the newly installed fluorescent tube FT2.

On the other hand, during the light emitting process of the fluorescent tube FT1, it is assumed that the high side filament HV is not broken, and the low side filament LV is broken. In this case, since the resistor R4 is coupled to the system voltage $V_{CC}$, the N-type transistor Q2 is turned on, so that the low voltage detection circuit 107*b* sends the second detecting signal DL of the low potential to the driving unit 105, so that the driving unit 105 stops generating the AC driving signal $D_{AC}$. When the broken fluorescent tube FT1 originally installed on the lamp holder LH is replaced by the good fluorescent tube FT2, since the low side filament LV of the fluorescent tube FT2 is not broken, the N-type transistor Q2 is turned off, so that the low voltage detection circuit 107*b* sends the second detecting signal DL of the high potential to the driving unit 105 in response to the system voltage $V_{CC}$, so that the driving unit 105 regenerates the AC driving signal $D_{AC}$ to drive the newly installed fluorescent tube FT2.

According to the above descriptions, when the fluorescent tube is broken, the driving apparatus stops providing power to both ends of the broken fluorescent tube regardless of whether the power switch related to the fluorescent tube is in the ON state or the OFF state, and thus making sure that a tube-replacing personnel is under safety conditions without getting an electric shock during a process of replacing the broken fluorescent tube. Meanwhile, after the broken fluorescent tube is replaced, it is unnecessary to switch the power switch related to the fluorescent tube, and the newly installed fluorescent tube can be automatically detected and automatically lighted up, and thus avoiding a potentially hazard for the tube-replacing personnel who climbs up and down a ladder repeatedly.

Figure 3:
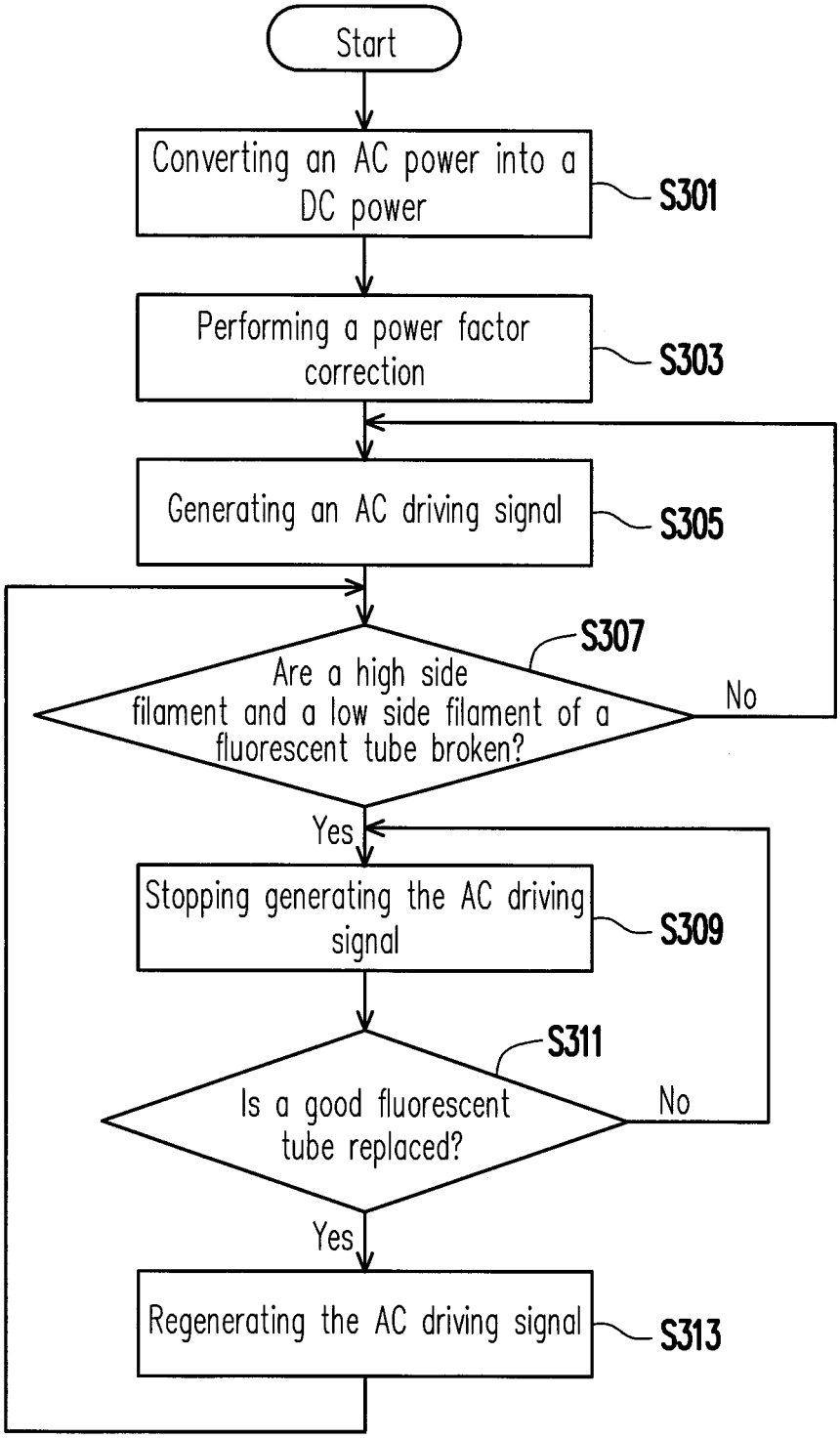
FIG. 3 is a flowchart illustrating a driving method of a fluorescent tube according to an embodiment of the invention.

According to the above descriptions, FIG. 3 is a flowchart illustrating a driving method of a fluorescent tube according to an embodiment of the invention. Referring to FIG. 3, the driving method of the fluorescent tube includes following steps.

An AC power is converted into a DC power (step S301).

A power factor correction is performed on the DC power (step S303).

An AC driving signal is generated in response to the power-factor corrected DC power (step S305), so as to drive a fluorescent tube installed on a lamp holder.

During a light emitting process of the fluorescent tube installed on the lamp holder, it is detected whether a high side filament and a low side filament of the fluorescent tube installed on the lamp holder are broken (step S307).

When at least one of the high side filament and the low side filament of the fluorescent tube installed on the lamp holder is broken, it is stopped generating the AC driving signal (step S309), otherwise, the step S305 is returned to continually drive the fluorescent tube installed on the lamp holder by the AC driving signal.

After generation of the AC driving signal is stopped, it is determined whether the broken fluorescent tube originally installed on the lamp holder is replaced by a good fluorescent tube (step S311).

When the broken first fluorescent tube originally installed on the lamp holder is replaced by the good fluorescent tube, the AC driving signal is regenerated (step S313) to drive the newly installed fluorescent tube, and the step S307 is returned. Otherwise (i.e. the broken fluorescent tube is still installed on the lamp holder), it is continuously stopped generating the AC driving signal.

In summary, in the driving apparatus of the fluorescent tube and the driving method thereof, when the fluorescent tube is broken, the driving apparatus stops providing power to both ends of the broken fluorescent tube regardless of whether the power switch related to the fluorescent tube is in an ON state or an OFF state, and thus making sure that a tube-replacing personnel is under safety conditions without getting an electric shock during a process of replacing the broken fluorescent tube with a good fluorescent tube. Meanwhile, after the broken fluorescent tube is replaced, it is unnecessary to switch the power switch related to the fluorescent tube, and the newly installed fluorescent tube can be automatically detected and automatically lighted up, and thus avoiding a potentially hazard for the tube-replacing personnel who climbs up and down a ladder repeatedly.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving apparatus of a fluorescent tube, comprising:

a conversion unit, receiving an alternating current (AC) power, and converting the AC power to provide a direct current (DC) power;

a power factor correction unit, coupled to the conversion unit, for performing a power factor correction to the DC power;

a driving unit, coupled to the power factor correction unit, for generating an AC driving signal in response to an output of the power factor correction unit, so as to drive a first fluorescent tube installed on a lamp holder; and a detection unit, coupled to the driving unit, for simultaneously and separately detecting whether a high side filament and a low side filament of the first fluorescent tube are broken, wherein when at least one of the high side filament and the low side filament is broken, the detection unit make the driving unit to stop generating the AC driving signal, and when the broken first fluorescent tube originally installed on the lamp holder is replaced by a good second fluorescent tube, the detection unit makes the driving unit to regenerate the AC driving signal to drive the second fluorescent tube.

2. The driving apparatus of the fluorescent tube as claimed in claim 1, wherein the detection unit comprises:

a high voltage detection circuit, coupled to the high side filament, for detecting whether the high side filament is broken, and sending a first detecting signal having a first state to the driving unit when the high side filament is broken, so as to make the driving unit to stop generating the AC driving signal, and sending the first detecting signal having a second state to the driving unit when the broken first fluorescent tube originally installed on the lamp holder is replaced by the good second fluorescent tube, so as to make the driving unit to regenerate the AC driving signal.

3. The driving apparatus of the fluorescent tube as claimed in claim 2, wherein the high voltage detection circuit comprises:

a switching unit, having a first terminal coupled to a system voltage, and a second terminal coupled to a first end of the high side filament, wherein the first end of the high side filament further receives the AC driving signal;

a first resistor, having a first end coupled to a second end of the high side filament;

a Zener diode, having a cathode coupled to a second end of the first resistor, and an anode coupled to a ground potential; and a second resistor, having a first end coupled to the cathode of the Zener diode and a control terminal of the switching unit for generating the first detecting signal to the driving unit, and a second end coupled to the ground potential.

4. The driving apparatus of the fluorescent tube as claimed in claim 3, wherein the switching unit comprises:

a third resistor, having a first end to be served as the first terminal of the switching unit and coupled to the system voltage; and a first transistor, having a source coupled to the system voltage, a drain to be served as the second terminal of the switching unit and coupled to the first end of the high side filament, and a gate to be served as the control terminal of the switching unit and coupled to a second end of the third resistor.

5. The driving apparatus of the fluorescent tube as claimed in claim 4, wherein the detection unit further comprises:

a low voltage detection circuit, coupled to the low side filament, for detecting whether the low side filament is broken, and sending a second detecting signal having a first state to the driving unit when the low side filament is broken, so as to make the driving unit to stop generating the AC driving signal, and sending the second detecting signal having a second state to the driving unit when the broken first fluorescent tube originally installed on the lamp holder is replaced by the good second fluorescent tube, so as to make the driving unit to regenerate the AC driving signal.

6. The driving apparatus of the fluorescent tube as claimed in claim 5, wherein the low voltage detection circuit comprises:

a fourth resistor, having a first terminal coupled to the system voltage;

a diode, having a cathode coupled to a first end of the low side filament, and an anode coupled to a second end of the fourth resistor, wherein a second end of the low side filament is coupled to the ground potential;

a first capacitor, having a first end coupled to the anode of the diode, and a second end coupled to the ground potential;

a second transistor, having a gate coupled to the first end of the first capacitor, a source coupled to the ground potential, and a drain for generating the second detecting signal to the driving unit; and a fifth resistor, having a first end coupled to the system voltage, and a second end coupled to the drain of the second transistor.

7. The driving apparatus of the fluorescent tube as claimed in claim 6, wherein the first transistor is a P-type transistor, and the second transistor is an N-type transistor.

8. The driving apparatus of the fluorescent tube as claimed in claim 6, further comprising:

a second capacitor, having a first end coupled to the second end of the high side filament, and a second end coupled to the first end of the low side filament.

9. The driving apparatus of the fluorescent tube as claimed in claim 2, wherein the high voltage detection circuit comprises:

a first resistor, having a first end coupled to a system voltage;

a diode, having an anode coupled to a second end of the first resistor, and a cathode coupled to a first end of the high side filament, wherein the first end of the high side filament further receives the AC driving signal;

a second resistor, having a first end coupled to a second end of the high side filament;

a Zener diode, having a cathode coupled to a second end of the second resistor, and an anode coupled to a ground potential; and a third resistor, having a first end coupled to the cathode of the Zener diode for generating the first detecting signal to the driving unit, and a second end coupled to the ground potential.

10. The driving apparatus of the fluorescent tube as claimed in claim 1, wherein the conversion unit comprises:

a bridge rectifier, receiving the AC power, and rectifying the AC power to provide the DC power; and a filter capacitor, coupled to the bridge rectifier, for filtering the DC power provided by the bridge rectifier.

11. The driving apparatus of the fluorescent tube as claimed in claim 1, wherein each of the first and the second fluorescent tube is at least a T3, T5, T8 or T9 hot-cathode fluorescent tube.

12. A method for driving a fluorescent tube, comprising:

converting an alternating current (AC) power into a direct current (DC) power;

performing a power factor correction on the DC power;

generating an AC driving signal in response to the power-factor corrected DC power, so as to drive a first fluorescent tube installed on a lamp holder to emit light;

simultaneously and separately detecting whether a high side filament and a low side filament of the first fluorescent tube are broken;

stopping generating the AC driving signal when at least one of the high side filament and the low side filament is broken; and regenerating the AC driving signal to drive the second fluorescent tube when the broken first fluorescent tube originally installed on the lamp holder is replaced by a good second fluorescent tube.

13. The method for driving the fluorescent tube as claimed in claim 12, further comprising:

continuously using the AC driving signal to drive the first fluorescent tube when none of the high side filament and the low side filament is broken.

14. The method for driving the fluorescent tube as claimed in claim 12, further comprising:

continuously stopping generating the AC driving signal when the broken first fluorescent tube is still installed on the lamp holder.

15. An illumination apparatus, comprising:

a lamp holder, installed with a first fluorescent tube;

a power switch; and a driving apparatus, driving the first fluorescent tube to emit light in response to an ON state of the power switch, and stopping driving the first fluorescent tube in response to an OFF state of the power switch, the driving apparatus comprising:

a conversion unit, receiving an alternating current (AC) power in response to the ON state of the power switch, and converting the AC power to provide a direct current (DC) power;

a power factor correction unit, coupled to the conversion unit, for performing a power factor correction to the DC power;

a driving unit, coupled to the power factor correction unit, for generating an AC driving signal in response to an output of the power factor correction unit, so as to drive the first fluorescent tube; and a detection unit, coupled to the driving unit, for simultaneously and separately detecting whether a high side filament and a low side filament of the first fluorescent tube are broken, wherein when at least one of the high side filament and the low side filament is broken, the detection unit makes the driving unit to stop generating the AC driving signal, and when the broken first fluorescent tube originally installed on the lamp holder is replaced by a good second fluorescent tube, the detection unit makes the driving unit to regenerate the AC driving signal to drive the second fluorescent tube.

16. The illumination apparatus as claimed in claim 15, wherein the detection unit comprises:

a high voltage detection circuit, coupled to the high side filament, for detecting whether the high side filament is broken, and sending a first detecting signal having a first state to the driving unit when the high side filament is broken, so as to make the driving unit to stop generating the AC driving signal, and sending the first detecting signal having a second state to the driving unit when the broken first fluorescent tube originally installed on the lamp holder is replaced by the good second fluorescent tube, so as to make the driving unit to regenerate the AC driving signal.

17. The illumination apparatus as claimed in claim 16, wherein the high voltage detection circuit comprises:

a switching unit, having a first terminal coupled to a system voltage, and a second terminal coupled to a first end of the high side filament, wherein the first end of the high side filament further receives the AC driving signal;

a first resistor, having a first end coupled to a second end of the high side filament;

a Zener diode, having a cathode coupled to a second end of the first resistor, and an anode coupled to a ground potential; and a second resistor, having a first end coupled to the cathode of the Zener diode and a control terminal of the switching unit for generating the first detecting signal to the driving unit, and a second end coupled to the ground potential.

18. The illumination apparatus as claimed in claim 17, wherein the switching unit comprises:

a third resistor, having a first end to be served as the first terminal of the switching unit and coupled to the system voltage; and a first transistor, having a source coupled to the system voltage, a drain to be served as the second terminal of the switching unit and coupled to the first end of the high side filament, and a gate to be served as the control terminal of the switching unit and coupled to a second end of the third resistor.

19. The illumination apparatus as claimed in claim 18, wherein the detection unit further comprises:

a low voltage detection circuit, coupled to the low side filament, for detecting whether the low side filament is broken, and sending a second detecting signal having a first state to the driving unit when the low side filament is broken, so as to make the driving unit to stop generating the AC driving signal, and sending the second detecting signal having a second state to the driving unit when the broken first fluorescent tube originally installed on the lamp holder is replaced by the good second fluorescent tube, so as to make the driving unit to regenerate the AC driving signal.

20. The illumination apparatus as claimed in claim 19, wherein the low voltage detection circuit comprises:

a fourth resistor, having a first terminal coupled to the system voltage;

a diode, having a cathode coupled to a first end of the low side filament, and an anode coupled to a second end of the fourth resistor, wherein a second end of the low side filament is coupled to the ground potential;

a first capacitor, having a first end coupled to the anode of the diode, and a second end coupled to the ground potential;

a second transistor, having a gate coupled to the first end of the first capacitor, a source coupled to the ground potential, and a drain for generating the second detecting signal to the driving unit; and a fifth resistor, having a first end coupled to the system voltage, and a second end coupled to the drain of the second transistor.

21. The illumination apparatus as claimed in claim 20, wherein the first transistor is a P-type transistor, and the second transistor is an N-type transistor.

22. The illumination apparatus as claimed in claim 20, further comprising:

a second capacitor, having a first end coupled to the second end of the high side filament, and a second end coupled to the first end of the low side filament.

23. The illumination apparatus as claimed in claim 16, wherein the high voltage detection circuit comprises:

a first resistor, having a first end coupled to a system voltage;

a diode, having an anode coupled to a second end of the first resistor, and a cathode coupled to a first end of the high side filament, wherein the first end of the high side filament further receives the AC driving signal;

a second resistor, having a first end coupled to a second end of the high side filament;

a Zener diode, having a cathode coupled to a second end of the second resistor, and an anode coupled to a ground potential; and a third resistor, having a first end coupled to the cathode of the Zener diode for generating the first detecting signal to the driving unit, and a second end coupled to the ground potential.

24. The illumination apparatus as claimed in claim 15, wherein the conversion unit comprises:

a bridge rectifier, receiving the AC power, and rectifying the AC power to provide the DC power; and a filter capacitor, coupled to the bridge rectifier, for filtering the DC power provided by the bridge rectifier.

25. The illumination apparatus as claimed in claim 15, wherein each of the first and the second fluorescent tube is at least a T3, T5, T8 or T9 hot-cathode fluorescent tube.

* * * * *